United States Patent [19]

Thompson

[11] 4,227,327

[45] Oct. 14, 1980

[54] SOLAR SIGN ASSEMBLY

[76] Inventor: Marion E. Thompson, P.O. Box 460, Colorado Springs, Colo. 80901

[21] Appl. No.: 30,608

[22] Filed: Apr. 11, 1979

[51] Int. Cl.[3] ..... G09F 11/12

[52] U.S. Cl. ..... 40/473

[58] Field of Search ..... 40/473, 456, 541; 320/2; 64/30 E

[56] References Cited

U.S. PATENT DOCUMENTS

| | | | |
|---|---|---|---|
| 323,995 | 2/1866 | Anthony | 40/473 |
| 1,948,834 | 2/1934 | Volk | 64/30 A |
| 2,656,630 | 10/1953 | McDonald | 40/473 |
| 2,808,669 | 10/1957 | Look | 40/473 |
| 3,031,784 | 5/1962 | Stein | 40/473 |
| 3,039,615 | 6/1962 | Uihlein | 40/473 |
| 3,089,070 | 5/1963 | Ralph | 320/2 |
| 3,286,385 | 11/1966 | Tate | 40/473 X |
| 3,295,240 | 1/1967 | Garte | 40/617 |
| 3,325,930 | 1/1967 | Braeutigam | 40/473 |
| 3,590,505 | 7/1971 | Benchley | 40/473 |
| 3,913,059 | 10/1975 | Matsui | 64/30 E |
| 3,918,183 | 11/1975 | Poutos | 40/473 |
| 3,964,189 | 6/1976 | Belokin | 40/473 X |
| 4,005,843 | 2/1977 | Wengel | 248/220.2 |

OTHER PUBLICATIONS

Educational Catalog: Central Scientific Co., for 1969; p. 114.

Catalog #752; dated 1975; p. 19; Edmund Scientific Co.

*Primary Examiner*—Gene Mancene

*Assistant Examiner*—Wenceslao J. Contreras

*Attorney, Agent, or Firm*—Cushman, Darby & Cushman

[57] ABSTRACT

A display assembly is provided including a base, a d.c. motor mounted completely within the base, a solar cell operatively mounted to the base, and a sign member rotated by the motor. A sleeve is provided on an elongated shaft connected to the sign member, and that sleeve slips over the motor shaft to provide an interference fit, but not a press fit. The sign has sufficient cross-sectional area to provide enough air-resistance so that, in combination with the interference fit between the shafts, the sign will turn at an appropriate speed for easy reading even though the motor shaft is turning much more quickly.

16 Claims, 6 Drawing Figures

SOLAR SIGN ASSEMBLY

BACKGROUND AND SUMMARY OF THE INVENTION

For the merchandising of products, and for providing conversation pieces in homes and offices, it is desirable to utilize simple attention capturing devices. While it is desirable that such devices be simple, it is also often desirable that some sort of a gimmick or unusual feature be associated with the display to attract and hold a viewer's interest.

According to the present invention, a display assembly is provided that is effective in capturing and holding a viewer's attention. The assembly according to the present invention is simple, inexpensive, and reliable and is imminently suitable as a point of purchase display item, conversation piece, or novelty item.

According to the present invention, an assembly is provided which comprises a base, a simple, inexpensive d.c. motor mounted within the base, the motor having a shaft, a solar cell, and a sign member. Means are provided, such as an outwardly extending arm or a flattened surface portion, for operatively connecting the solar cell to the base while providing electrical interconnection between the solar cell and the motor. The sign member has an elongated shaft operatively connected thereto and elongated in a plane substantially coincident with or parallel to the sign member planar surface having indicia formed thereon. Means are provided for interconnecting the sign member shaft and the motor shaft so that the motor rotates the sign member with respect to the base when incident radiation of sufficient intensity strikes the solar cell. The sign member planar surface provides a message area which can be utilized to display company logos, humorous sayings, people's names and title, etc., the rotation of the sign member combined with the solar cell as the power source providing an effective attention getting and holding arrangement.

Most inexpensive d.c. motors rotate the shafts associated therewith at a speed too fast for normal recognition of indicia on a sign member connected to such a shaft. Therefore, according to the present invention the sign member is slowed down to a speed appropriate for normal recognition in a simple and inexpensive manner. This is accomplished by choosing the area of the sign member, and by constructing the means for interconnecting the sign member shaft and the motor shaft, so that the desired lower speed of rotation is obtained. The means for interconnecting the sign member shaft and the motor shaft preferably consists essentially of an elongated sleeve formed in the end of the sign member shaft distal from the sign member having a circular inside diameter slightly greater than the circular outside diameter of the motor shaft so that the sign member shaft slips over the motor shaft and forms an interference fit, but not a press fit, therewith. The sign member and elongated shaft may be formed of injection molded plastic, and the sleeve inside diameter may be chosen of approximately 0.010 inches greater than the motor shaft diameter, to provide the interference, but not press, fit.

The base may be formed in a wide variety of manners, such as with a flat bottom portion for placing on a table surface or the like, or being sized to fit on the top of a conventional beer can, or having a tubular bottom adapted to sit over the neck of a whiskey bottle. Additionally, especially for point of purchase displays, a rechargable battery may be provided, as well as circuitry means for operatively connecting the solar cell, battery, and d.c. motor so that the motor will run and the battery will be recharged when sufficient incident radiation strikes the solar cell, and so that the motor will be run by the battery when insufficient incident radiation strikes the solar cell.

It is the primary object of the present invention to provide a simple attention-getting and holding display assembly. This and other objects of the invention will become clear from an inspection of the detailed description of the invention, and from the appended claims.

DETAILED DESCRIPTION OF THE DRAWINGS

Figure 1:
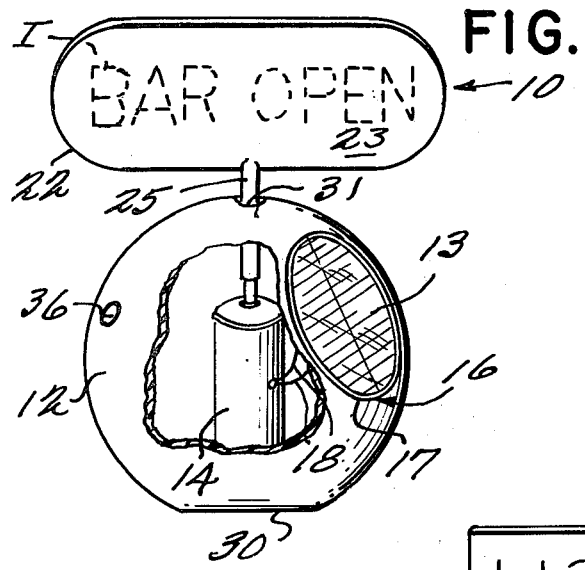
FIG. 1 is a perspective view, with portion of the exterior of the base cut away to reveal the interior thereof, of an exemplary display assembly according to the present invention.
Figure 2:
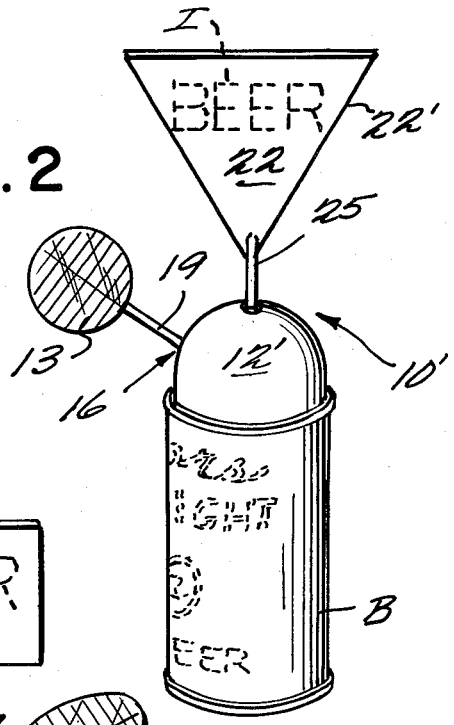
FIGS. 2 and 3 are perspective views of further embodiments of the display assembly of FIG. 1.
Figure 3:
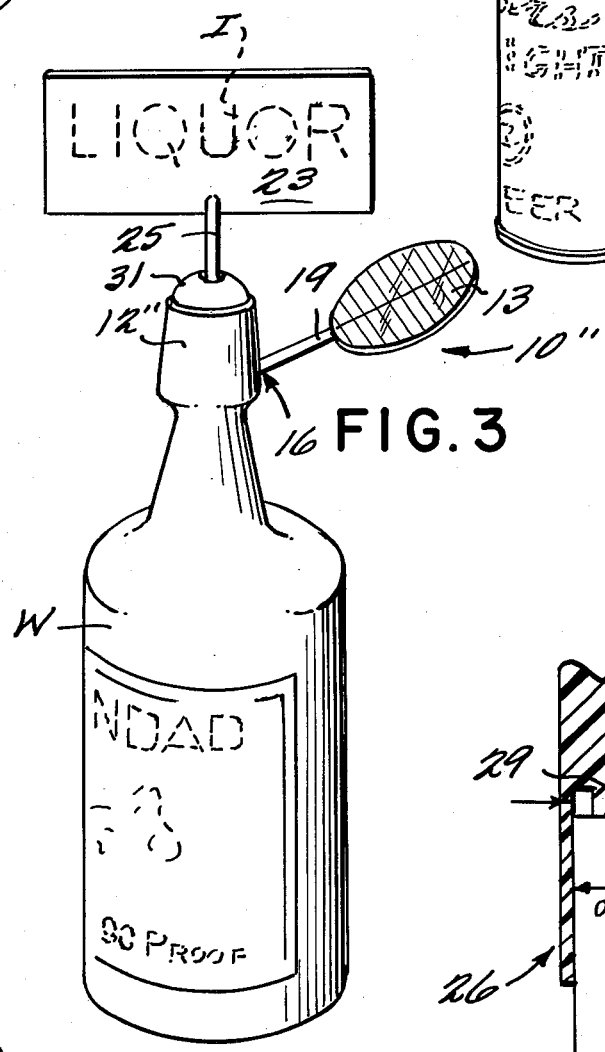

Exemplary display assemblies according to the present invention are illustrated generally at 10, 10', and 10'' in FIGS. 1–3, respectively. Each assembly includes a base 12 (12', 12''), a conventional solar cell 13, and a d.c. motor 14 mounted in the base 12 and completely surrounded thereby, the motor having a shaft 15. Preferably the d.c. motor 14 is of an inexpensive type having a high r.p.m. and high current drain. Means are provided, shown generally at 16, for operatively connecting the solar cell 13 to the base 12 (12', 12'') while providing electrical interconnection between the cell 13 and motor 14. Such means may take the form of a flattened side portion 17 (see FIG. 1) of the dome-shaped base 12, with wires 18 interconnecting the solar cell 13 with the motor 14; or the means 16 may take the form of an arm 19 (see FIGS. 2 and 3) extending outwardly from a bottom portion of the base.

Figure 4:
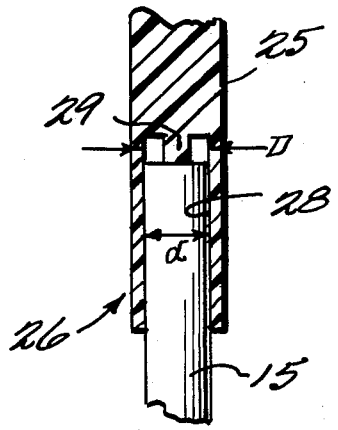
FIG. 4 is a side, enlarged view partly in cross-section and partly in elevation showing the interconnection between the motor shaft and sign member shaft according to the present invention.

The assembly 10 further comprises a sign member 22 having a substantially planar surface 23 with indicia I formed thereon, the indicia displaying a humorous saying, company logo, instructive information, or the like. An elongated shaft 25 is operatively connected to the sign member 22 and elongated in a plane substantially coincident with or parallel to the planar surface 23. Means are also provided for interconnecting the shafts 25, 15 so that the motor rotates the sign member 22 with respect to the base 12 when incident radiation of sufficient intensity (e.g. from the sun or a strong incedescent light bulb) strikes the solar cell 13. One exemplary such interconnecting means are shown generally at 26 in FIG. 4.

The motor 14 normally rotates its shaft 15 at a speed too fast for normal recognition of the indicia I. Therefore, the area of the sign member 22 is chosen, and the means 26 are so constructed, that the sign member 22 rotates at a speed appropriate for normal recognition of the indicia I on sign member 22. The exact cross-sectional area of the surface 23 will of course depend upon the exact nature of the motor 14, however in one exemplary embodiment according to the present invention utilizing a conventional readily available d.c. motor 14 with the base 12' sized to fit on top of a beer can B (see FIG. 2), the area of the sign 22' would be about 250 sq. inches.

Figure 5:
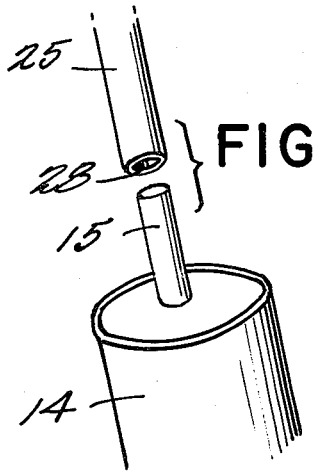
FIG. 5 is a perspective view of the shafts illustrated in FIG. 4.

Preferably, the means 26 for interconnecting the shafts 15, 25 consists essentially of a sleeve 28 (see FIGS. 4 and 5) formed in the end of the shaft 25 distal from the sign member 22 and having an inside circular diameter D slightly greater than the outside circular diameter d of the motor shaft 15 so that the sleeve 28 slips over the shaft 15 until the surface 29 abuts the top of the shaft 15, so that an interference fit (but not a press fit) is provided between the sleeve 28 and shaft 15. One suitable way of accomplishing this is by injection molding the sign member 22 and elongated shaft 25 of plastic, and making the diameter D approximately 0.010 inches greater than the diameter d.

With the construction of the device according to the present invention, the sign members 22 are readily removable from the base 12 merely by slipping the sleeve 28 on or off the shaft 15, and an excellent speed reduction is provided by the air resistance to the sign member 22 as it rotates, and the slip coupling provided between the sleeve 28 and shaft 15.

Figure 6:
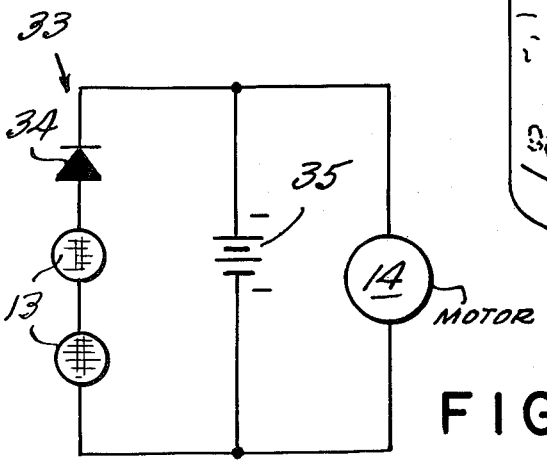
FIG. 6 is a schematic circuit diagram indicating the interconnection between various electrical components for use with the display assembly according to the present invention.

While the base member may take a wide variety of shapes, one preferred form, as shown in FIG. 1, includes forming a flat bottom portion 30 on the domed pace member 12 opposite a top portion thereof, which top portion of the base 12 has an opening 31 formed therein through which at least one of the motor shaft 15 and the sign member shaft 25 passes. As shown in FIG. 2, the base 12' flat bottom portion may be substantially the same size and shape as the top of a conventional beer can B, whereby the assembly 10' may be rested directly atop the beer can B. Alternatively, as shown in FIG. 3, the base member 12" may comprise a tubular portion distal from the top portion thereof which has the opening 31 formed therein, the tubular portion having an inside diameter large enough to fit on the neck of a whiskey bottle W. In situations where it is desirable to rotate the sign 22 even when there is not direct incident radiation (for instance in many point of purchase environments) it is desirable to also provide a conventional rechargable battery. As illustrated in FIG. 6, circuitry means 33, including a diode 34, operatively connect a rechargable battery 35 with the motor 14 and with the solar cells 13 so that the motor 14 will run and the battery 35 will be recharged when sufficient incident radiation strikes the cell, and so that the motor will be run by the battery 35 when insufficient incident radiation strikes the solar cell 13. A plurality of solar cells (e.g. 4 or 5) 13 may be provided, especially for point of purchase displays. The diode 34 and solar cells 13 are connected in series with the motor 14, and the battery 35 is connected in parallel with the diode 34 and solar cells 13.

An exemplary operation of the display assembly according to the present invention is as follows:

The user slips the sleeve 28 of an elongated shaft 25 connected to a display sign member 22 over the shaft 15 of a motor 14 of the device 10, and the base member 12 is placed in a position wherein incident radiation (e.g. solar or high intensity incadescent bulb radiation) impinges directly upon the cell 13. By utilizing a mounting arm 19, the possibility of a shadow being cast by the sign member 22 on the solar cell 13 is minimized. The radiation impinging upon the cell 13 is converted into electricity which is carried by lines 18 to the motor 14 to thereby rotate the shaft 15. The shaft 15 rotates at relatively high speed but because of the slip-nature of the interconnection 26 between the shaft 15 and the shaft 25, and because of the air resistance provided by the large surface area 23 of the sign 22, the sign 22 rotates at a speed allowing ready normal recognition of the indicia I. At any desired time the sign 22 may be changed merely by pulling the old sign off and placing the new sign in operative association with the motor shaft 15.

While the assembly 10 according to the present invention is primarily for use as an attention-catching and holding device, of course it is also useful in situations where it is necessary to impart necessary information to people in the area and where ready access to an electrical outlet is not provided. Additionally, the base 12 can have other uses at the same time it provides support for the motor 14 and solar cell 13. For instance, an opening 36 (see FIG. 1) may be provided in the base 12 appropriately dimensioned and positioned to receive a pen, pencil, or like writing instrument therein.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent assemblies and devices.

What is claimed is:

1. An assembly comprising a base;

a d.c. motor mounted in said base and completely surrounded thereby, said motor having a shaft;

a solar cell;

means for operatively connecting said solar cell to said base while providing electrical interconnection between said cell and said motor;

a sign member having a substantially planar surface with word indicia formed thereon;

an elongated shaft-like member operatively connected to said sign member and elongated in a plane substantially coincident with or parallel to said sign member planar surface;

means for interconnecting said sign member shaft-like member and said motor shaft so that said motor rotates said sign member with respect to said base when incident radiation of sufficient intensity strikes said solar cell;

said d.c. motor normally rotating its shaft at a speed too fast for normal recognition of the word indicia on said sign member; and the area of said sign member being chosen, and said means for interconnecting said sign member shaft-like member and said motor shaft being so constructed, that said sign member rotates at a speed, slower than the motor shaft, appropriate for normal recognition of the word indicia on said sign member.

2. An assembly as recited in claim 1 wherein said sign member shaft-like member is a rigid shaft, and wherein said means for interconnecting said sign member shaft and said motor shaft consists essentially of:

said motor shaft formed of a cylinder having a circular cross-section, and said sign member shaft having an elongated sleeve formed in the end thereof distal from said sign member, said sleeve having an inside circular diameter slightly greater than the diameter of said motor shaft so that it slips over said motor shaft and forms an interference fit, but not a press fit, therewith.

3. An assembly as recited in claim 2 wherein said sign member and elongated shaft are formed of injection molded plastic.

4. An assembly as recited in claim 2 wherein said sleeve inside diameter is approximately 0.010 inches greater than said motor shaft diameter.

5. An assembly as recited in claim 1 wherein said base member has a flat bottom portion thereof opposite a top portion thereof, which top portion has an opening formed therein through which at least one of said motor shaft and said sign member shaft passes.

6. An assembly as recited in claim 1 wherein said base member has a flat bottom portion thereof opposite a top portion thereof, which top portion has an opening formed therein through which at least one of said motor shaft and said sign member shaft passes, said flat bottom portion being substantially the same size and shape as a beer can top.

7. An assembly as recited in claim 1 wherein said base member comprises a tubular portion distal from a top portion thereof, which top portion has an opening formed therein through which at least one of said motor shaft and said sign member shaft passes, said tubular portion having an inside diameter large enough to fit on the neck of a whiskey bottle.

8. An assembly as recited in claims 1 or 2 wherein said means for operatively connecting said solar cell to said base comprises a flattened side portion of said base.

9. An assembly as recited in claim 1 or 2 wherein said means for operatively connecting said solar cell to said base comprises an arm extending outwardly from a bottom portion of said base, remote from said sign member.

10. An assembly as recited in claim 1 further comprising a rechargeable battery and circuitry means for operatively connecting said solar cell, battery, and d.c. motor so that said motor will run and said battery will be recharged when sufficient incident radiation strikes said solar cell, and so that said motor will be run by said battery when insufficient incident radiation strikes said solar cell.

11. An assembly as recited in claim 10 wherein said circuitry means comprises means interconnecting a diode in series with said solar cell and motor, and means interconnecting said battery in parallel with said solar cell and diode.

12. An assembly comprising a base;

a DC motor mounted in said base and completely surrounded thereby, said motor having a cylindrical shaft;

a solar cell;

means electrically innerconnecting said solar cell and said DC motor;

a sign member having a substantially planar surface with indicia formed thereon;

an elongated shaft operatively connected to said sign member and elongated in a plane substantially concident with or parallel to said sign member planar surface; and means for interconnecting said sign member shaft and said motor shaft, and wherein the area of said sign member is chosen, so that said sign member rotates at a substantially slower speed than the speed of rotation of said motor shaft, said interconnecting means comprising: said motor shaft formed of circular cross section, and said sign member shaft having an elongated sleeve formed in an end thereof distal from said sign member, said sleeve having an inside circular diameter slightly greater than the diameter of said motor shaft so that it slips over said motor shaft and forms an interference fit, but not a press fit, therewith.

13. An assembly as recited in claim 12 wherein said innerconnecting means consists essentially of said motor and sign shafts.

14. An assembly as recited in claim 12 wherein said sign member and said elongated shaft are formed of injection molded plastic.

15. An assembly as recited in claims 12, 13, or 14 wherein said sleeve inside diameter is approximately 0.010 inches greater than said motor shaft diameter.

16. An assembly as recited in claims 12 or 13 further comprising a rechargeable battery and circuitry means for operatively connecting said solar cell, battery, and DC motor so that said motor will run and said battery will be recharged when sufficient incident radiation strikes the solar cell, and so that said motor will be run by said battery when insufficient incident radiation strikes the solar cell.

* * * * *